US006629660B1

(12) United States Patent
Yamaguchi et al.

(10) Patent No.: US 6,629,660 B1
(45) Date of Patent: Oct. 7, 2003

(54) TAKE-UP METHOD AND DEVICE FOR SYNTHETIC FIBER AND METHOD OF USING THREAD PACKAGE

(75) Inventors: Sumio Yamaguchi, Ishikawa (JP); Tamotsu Suzuki, Ishikawa (JP); Hirotaka Nakajima, Nara (JP); Katsumi Sonoyama, Ishikawa (JP); Kazumasa Yamashita, Ishikawa (JP); Teruaki Saijo, Ishikawa (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/530,641

(22) PCT Filed: Sep. 3, 1999

(86) PCT No.: PCT/JP99/04796

§ 371 (c)(1),
(2), (4) Date: Apr. 27, 2000

(87) PCT Pub. No.: WO00/14003

PCT Pub. Date: Mar. 16, 2000

(30) Foreign Application Priority Data

Sep. 4, 1998 (JP) ..... 10-251598

(51) Int. Cl.[7] ..... B65H 54/22; B65H 67/048

(52) U.S. Cl. ..... 242/474.7; 242/474.5; 242/476.4; 242/476.5

(58) Field of Search ..... 242/474.5, 474.6, 242/474.7, 476.4, 476.5

(56) References Cited

U.S. PATENT DOCUMENTS 3,999,715 A * 12/1976 Schippers et al. ..... 242/474.6

(List continued on next page.)

FOREIGN PATENT DOCUMENTS

| | | | | |
|---|---|---|---|---|
| EP | 367253 A1 * | 5/1990 | | |
| JP | 54-114674 | 6/1979 | ..... | B65H/67/04 |
| JP | 57-36233 | 8/1982 | | |
| JP | 62-280172 | 5/1987 | ..... | B65H/67/048 |
| JP | 06-321424 | 11/1994 | ..... | B65H/54/34 |
| JP | 8-133600 A * | 5/1996 | | |

*Primary Examiner*—Donald P. Walsh
*Assistant Examiner*—Joseph C Rodriguez
(74) *Attorney, Agent, or Firm*—Piper Rudnick LLP

(57) ABSTRACT

A method and apparatus for winding synthetic fibers is disclosed. According to the invention, a yarn is wound around a bobbin without winding a tail bunch, at a high successful bobbin-to-bobbin yarn transfer rate for a variety of yarn properties, i.e. different in thickness, lubricant used, etc., while inhibiting the loosening of the yarn tail into single fibers and stably and easily forming a proper yarn tail length. Tail bunch removing work is not required and the winding process is stabilized. A yarn is wound around an empty bobbin using a yarn winding apparatus composed of a traverse fulcrum guide, a traverse device, a contact pressure roller, two spindles, a moving device for moving the spindles, and a yarn transfer device for introducing the yarn into a yarn holding portion for holding the yarn. The yarn transfer device is composed of an upper yarn passage guide, a lower yarn passage guide, and a surface bunching guide respectively provided at positions upstream and downstream of the empty bobbin in the yarn running direction. The yarn is moved outside the traverse width, to be kept almost parallel to the yarn holding portion by the upper yarn passage guide and the lower yarn passage guide, pressed to the empty bobbin by at least either of the guides, moved to the yarn holding portion by at least either of the guides, and held and cut by the yarn holding portion the holding point of the yarn is allowed to move in the rotating direction of the empty bobbin reverse to the running direction of the yarn. The yarn is allowed to be automatically disengaged from the upper yarn guide, and is moved toward the center of the traverse without forming the initially straight-wound yarn tail bunch, and that when the yarn is engaged with the traverse guide, regular winding is started.

30 Claims, 17 Drawing Sheets

U.S. PATENT DOCUMENTS 4,216,920 A * 8/1980 Tambara et al. ..... 242/474.6
5,029,762 A * 7/1991 Behrens et al. ..... 242/473.5
5,228,630 A * 7/1993 Nakai et al. ..... 242/474.5
5,318,232 A * 6/1994 Busenhart et al. ..... 242/474.6
5,431,353 A * 7/1995 Horler ..... 242/474.6
6,045,081 A * 4/2000 Oberstrass et al. ..... 242/473.8
6,070,827 A * 6/2000 Spahlinger et al. ..... 242/474.5
6,158,689 A * 12/2000 Mayer et al. ..... 242/476.4

* cited by examiner

TAKE-UP METHOD AND DEVICE FOR SYNTHETIC FIBER AND METHOD OF USING THREAD PACKAGE

TECHNICAL FIELD

The present invention relates to a method for winding synthetic fibers, a synthetic fiber winding apparatus, and a method for using a yarn package.

In more detail, the present invention relates to a technique for winding a yarn around a yarn winding bobbin without winding the initially straight-wound yarn tail bunch destined to be wasted later, positioned outside said yarn package, for getting rid of the tail bunch removing work, at a high successful bobbin-to-bobbin yarn transfer rate, and a technique incidental to said technique, for forming a yarn tail (transfer tail) with a proper length without splitting the tail, furthermore a technique for preventing the yarn end of a wound yarn package from slipping from the surface of the wound yarn package, and, in addition, a technique for carrying out the tail splicing work simply when using the package (for weaving or yarn processing, etc.).

BACKGROUND ART

A general winding machine with a mechanism for automatically transferring yarns from yarn winding bobbins to other yarn winding bobbins is described below in reference to FIGS. 1 and 2, and 3 through 7.

FIG. 1 is a schematic front view showing a multiple-yarn winding machine. FIG. 2 is a schematic side view showing a multiple-yarn winding machine. FIGS. 3 to 7 are schematic drawings expressing the action of automatic transfer of one yarn from a wound yarn package to an empty bobbin in time series. A winding machine 1 is composed of a turret plate 3 rotatably installed in a machine casing, two spindles 4 rotatably installed on the turret plate 3, a traverse fulcrum guide 20 for directing the yarn to a traverse device 5 installed above one of the spindles 4, yarn winding empty bobbins 16 mounted around the spindle 4, a contact pressure roller 6 for giving a predetermined face pressure to the yarns wound around the bobbins while being kept in contact with them, an upper yarn transfer mechanism 7 provided above the contact pressure roller 6, a yarn passage control mechanism 8 provided between the two spindles 4 for controlling the yarn passages when the yarns are transferred from wound yarn bobbins 17 to the empty bobbins 16, and a lower yarn transfer mechanism 12 provided between the empty bobbins 16 and the yarn passage control mechanism 8 for winding the yarns around the empty bobbins 16. The upper yarn transfer mechanism 7 is composed of yarn shift guides 9 moving in the traverse direction of a traverse guide for shifting the yarns outside the respective regular traverse areas to tail bunching positions and tail winding positions, and a drive source (not illustrated) for these actions. The yarn passage control mechanism 8 is composed of a yarn passage control guide 10 for controlling the yarn passages lest the yarns should contact the peripheral surfaces of the empty bobbins when the empty bobbins 16 at the standby position move to the winding position, and surface yarn bunching guides 11 for guiding the yarn passages toward the surface yarn bunching positions on the surfaces of the yarns wound around the fully wound packages 17.

The lower yarn transfer mechanism 12 is composed of initial winding guides 13 for guiding the yarns running between the yarn shift guides 9 and the yarn passage control guide 10 into contact with the peripheral surfaces of the empty bobbins 16 and moving the yarns in the axial direction of the empty bobbins 16 to let yarn holding portions 23 provided in the empty bobbins 16 hold the yarns, and arms 13' (not illustrated) for actuating the initial winding guides 13 between the standby position and the winding position.

When the winding machine as mentioned above is used to change the yarns from the wound yarn packages 17 to the empty bobbins 16, the turret plate 3 is at first rotated 180 degrees clockwise, to move the wound yarn packages 17 at the winding position to the standby position, and to move the empty bobbins 16 at the standby position to the winding position.

At this time, as shown in FIG. 3, the yarn passage control guide 10 of the yarn passage control mechanism 8 is interlocked with the rotation of the turret 3 (not illustrated), to disengage the yarns from the traverse guide (not illustrated) and controls and supports the yarn passages lest the yarns should contact the peripheral surfaces of the empty bobbins 16.

Then, as shown in FIG. 4, the yarn shift guides 9 of the upper yarn transfer mechanism 7 carry the yarns outside the respective regular traverse areas, and the surface bunching guides 11 of the yarn passage control mechanism 8 let the yarns travel toward the surface bunching positions on the yarn windings of the wound yarn packages 17.

Then, as shown in FIG. 5, the initial winding guides 13 of the lower yarn transfer mechanism 12 (not illustrated) move into the space between the empty bobbins 16 and the yarn passage control mechanism 8, and as a result, the running yarns controlled in their passages by the yarn shift guides 9 of the upper yarn transfer mechanism (not illustrated) and the surface bunching guides 11 of the lower yarn transfer mechanism 8 are brought into contact with the peripheral surfaces of the empty bobbins 16 by the initial winding guides 13 and are moved in the axial direction of the empty bobbins 16, being introduced into and held by the yarn holding portions 23 provided in the circumferential direction of the empty bobbins 16 at the ends on one side of the empty bobbins 16. If the yarns are held, since both the fully wound packages 17 and the empty bobbins 16 rotate in the yarn winding direction, the yarns are cut in the space between the wound yarn packages 17 and the empty bobbins 16, and are transferred from the wound yarn packages 17 to the empty bobbins 16.

Then, as shown in FIG. 6, since the yarns are guided to shift toward the tail bunching positions of the empty bobbins by the yarn shift guides 9, the yarns coming out of the yarn holding portions move on to the peripheral surfaces of the empty bobbins 16, to form tail bunches at the predetermined winding positions.

Then, as shown in FIG. 7, after predetermined lengths of tail bunches have been wound, as the yarn shift guides 9 return toward the opposite ends of the bobbins, the yarns move toward the centers of the traverse areas while forming their tails, and are taken over by the traverse guide (not illustrated), to be wound in traverse.

As described above, in the automatic bobbin-to-bobbin yarn transfer according to the above mentioned conventional winding method and apparatus, after the yarns have been transferred to the empty bobbins, the yarn shift guides 9 of the upper yarn transfer mechanism 7 which support the yarns at the tail bunching positions against the force to move the yarns toward the centers of the traverse areas cause the yarns held by the empty bobbins 16 to be wound right under the yarn shift guides 9, to form tail bunches without fail. As a result, the formed tail bunches must be removed later, and this has been an extra burden of working.

Apart from the above apparatus, Japanese Patent Laid-Open (Kokai) No. Sho62-280172, Japanese Patent Publication (Kokoku) No. Sho57-36233 and Japanese Patent Laid-Open (Kokai) No. Hei6-321424 propose other turret type automatic winding machines, but all of these machines have the same problem as described above, since the yarn is supported against the force to move the yarn toward the center of the traverse area after it has been transferred to an empty bobbin, a tail bunch is formed without fail.

On the other hand, a winding apparatus without forming the tail bunch proposed in Japanese Patent Laid-Open (Kokai) No. Sho54-114674 is known.

However, with this apparatus, the yarn passage for introducing a yarn into a yarn holding groove extending in the circumferential direction in the surface of an empty bobbin is oblique to the yarn holding groove. As a result, the yarn cannot be reliably held, and it is difficult to achieve a high successful bobbin-to-bobbin yarn transfer rate for a variety of yarns different in physical properties and thickness.

To avoid these problems, it is proposed to form a groove oblique to a yarn fastener which supports the yarn at a position downstream of an empty bobbin when the yarn is introduced into the groove, or to move the spindle at the standby position in parallel to the spindle axis for letting the winding width of the wound yarn package reaching the standby position come right under the yarn holding groove without using the yarn fastener. These methods allow the yarn passage for introducing the yarn into the yarn holding groove to be kept in parallel to the yarn holding groove. However, the method of forming a groove oblique to a yarn fastener has a problem that since the frictional force generated at the oblique groove portion lowers the winding tension, the successful bobbin-to-bobbin yarn transfer rate is lowered, and the method of moving the spindle has a problem that the equipment becomes complicated to raise the equipment cost greatly.

Furthermore, even if the yarn passage for introducing the yarn into the yarn holding groove is kept in parallel to the yarn holding groove by either of the above methods, there is a problem that the tail of the yarn is loosened, in another word, split into single filaments, instead of being kept integral as a multi-filament. The reason why the tail of the yarn is split is that since the held yarn is immediately wound in the direction reverse to the running direction, the component single filaments become different from each other in tension, and that since there is no tail bunch, the tail dispersed in tension begins to be immediately wound. A package split at the tail has a problem that tail splicing work becomes difficult.

Moreover, though the freedom from the tail bunch does not require the work of removing the tail bunch later, the winding end of the wound yarn package slips from the surface of the wound yarn package, to be wound around an end of the bobbin. So the yarn wound around the bobbin end must be removed later, and after all, the working load is not reduced disadvantageously.

DISCLOSURE OF THE INVENTION

A first object of the present invention is to provide a method for winding synthetic fibers around a yarn winding empty bobbin, without forming the initially straight-wound yarn tail bunch to be wasted later, positioned outside the package, at a high successful bobbin-to-bobbin yarn transfer rate for a variety of yarns different in physical properties and thickness, for getting rid of the work of removing the tail bunch later, while assuring a stable winding process.

A second object of the present invention, in addition to the first object, is to provide a method for winding synthetic fibers, without causing the tail of a yarn to be split loosely into single fibers while allowing the stable and easy formation of a yarn tail with a length suitable for the tail splicing work of various kinds of yarns under various service conditions. Thus, the tail splicing work for using the package (for weaving or yarn processing, etc.) can be effected efficiently, and the present invention is intended to provide a method for winding synthetic fibers which allows the tail splicing work to be effected efficiently.

A third object of the present invention is to provide a method for winding synthetic fibers, which allows winding as a wound yarn package unlikely to cause the end of the yarn winding of the wound yarn package to slip from the surface of the wound yarn package. It is intended to provide a method for winding synthetic fibers, which can reduce the later work of removing the yarn end slipping from the surface and wound around an end of the bobbin.

A fourth object of the present invention is to provide a method, which allows the tail splicing work for using a package (for weaving, yarn processing, etc.) to be effected simply.

The method for winding a yarn of the present invention to achieve these objects is constituted as follows.

The present invention provides a method for winding synthetic fibers, in which a yarn is wound around an empty bobbin using a yarn winding apparatus composed of a traverse fulcrum guide for winding the yarn, a traverse device for traversing the yarn before winding it, a contact pressure roller for giving a predetermined face pressure to the wound yarn in contact with it, two spindles alternately used for winding the traversed yarn, a moving device for moving the spindles for transferring the yarn continuously from the spindle on the winding side to the spindle on the standby side, and a yarn transfer device for introducing the yarn into a yarn holding portion for holding the yarn, wherein said yarn transfer device is composed of an upper yarn transfer mechanism provided upstream of the empty bobbin mounted around the spindle on the winding side, a lower yarn transfer mechanism provided downstream, and a yarn passage control mechanism for controlling the yarn passage of the yarn extending to the wound yarn package moved to the standby side, comprising the steps of shifting the yarn outside the regular traverse area, to keep it almost parallel to the yarn holding portion by the upper yarn transfer mechanism and the lower yarn transfer mechanism; moving the yarn to the yarn holding portion by at least either of the upper yarn transfer mechanism and the lower yarn transfer mechanism, allowing the yarn to be held and cut by the yarn holding portion; allowing the holding point of the yarn to be moved in the rotating direction of the empty bobbin reverse to the running direction of the yarn; allowing the yarn to be automatically disengaged from the upper yarn transfer mechanism; moving the yarn toward the center of the traverse without forming the initially straight-wound yarn tail bunch; and starting regular winding when the yarn is engaged with the traverse guide. The present invention also provides a method for winding synthetic fibers, wherein the lower yarn transfer mechanism is an initial winding guide for bringing the yarn controlled by the upper yarn transfer mechanism and the yarn passage control mechanism into contact with the peripheral surface of the empty bobbin, and moving the yarn in the axial direction of the empty bobbin, to let the yarn holding portion hold the yarn. In more detail, the present invention provides a method for winding synthetic fibers, wherein the upper yarn transfer mechanism is composed of a yarn shift guide for shifting the yarn outside the regular traverse area, to let another guide to keep it, and returning to its home position, and a yarn keep guide for temporarily keeping the shifted yarn.

The yarn winding apparatus of the present invention to achieve the above objects is constituted as follows.

The present invention provides a synthetic fiber winding apparatus, in which a yarn is wound around an empty bobbin using a yarn winding apparatus composed of a traverse fulcrum guide for winding the yarn, a traverse device for traversing the yarn before winding it, a contact pressure roller for giving a predetermined face pressure to the wound yarn in contact with it, two spindles alternately used for winding the traversed yarn, a moving device for moving the spindles for transferring the yarn continuously from the spindle on the winding side to the spindle on the standby side, and a yarn transfer device for introducing the yarn into a yarn holding portion for holding the yarn, wherein said yarn transfer device is composed of an upper yarn transfer mechanism provided upstream of the empty bobbin mounted around the spindle on the winding side, a lower yarn transfer mechanism provided downstream, and a yarn passage control mechanism for controlling the yarn passage of the yarn extending to the wound yarn package moved to the standby side, characterized in that the yarn is moved outside the regular traverse area, to be kept almost parallel to the yarn holding portion by the upper yarn transfer mechanism and the lower yarn transfer mechanism, and moved to the yarn holding portion by at least either of the upper yarn transfer mechanism and the lower yarn transfer mechanism, to be held and cut by the yarn holding portion, that the holding point of the yarn is allowed to move in the rotating direction of the empty bobbin reverse to the running direction of the yarn, that the yarn is allowed to be automatically disengaged from the upper yarn transfer mechanism, and is moved toward the center of the traverse without forming the initially straight-wound yarn tail bunch, and that when the yarn is engaged with the traverse guide, regular winding is started. The present invention also provides a synthetic fiber winding apparatus, wherein the lower yarn transfer mechanism is an initial winding guide for bringing the yarn controlled by the upper yarn transfer mechanism and the yarn passage control mechanism into contact with the peripheral surface of the empty bobbin, and moving the yarn in the axial direction of the empty bobbin, to let the yarn holding portion hold the yarn. In more detail, the present invention provides a synthetic fiber winding apparatus, wherein the upper yarn transfer mechanism is composed of a yarn shift guide for shifting the yarn outside the regular traverse area, to let another guide keep the yarn kept, and returning to its home position, and a yarn keep guide for temporarily keeping the shifted.

THE BEST EMBODIMENTS OF THE INVENTION

Embodiments of the present invention are described below in reference to FIGS. 12 through 20.

Figure 12:
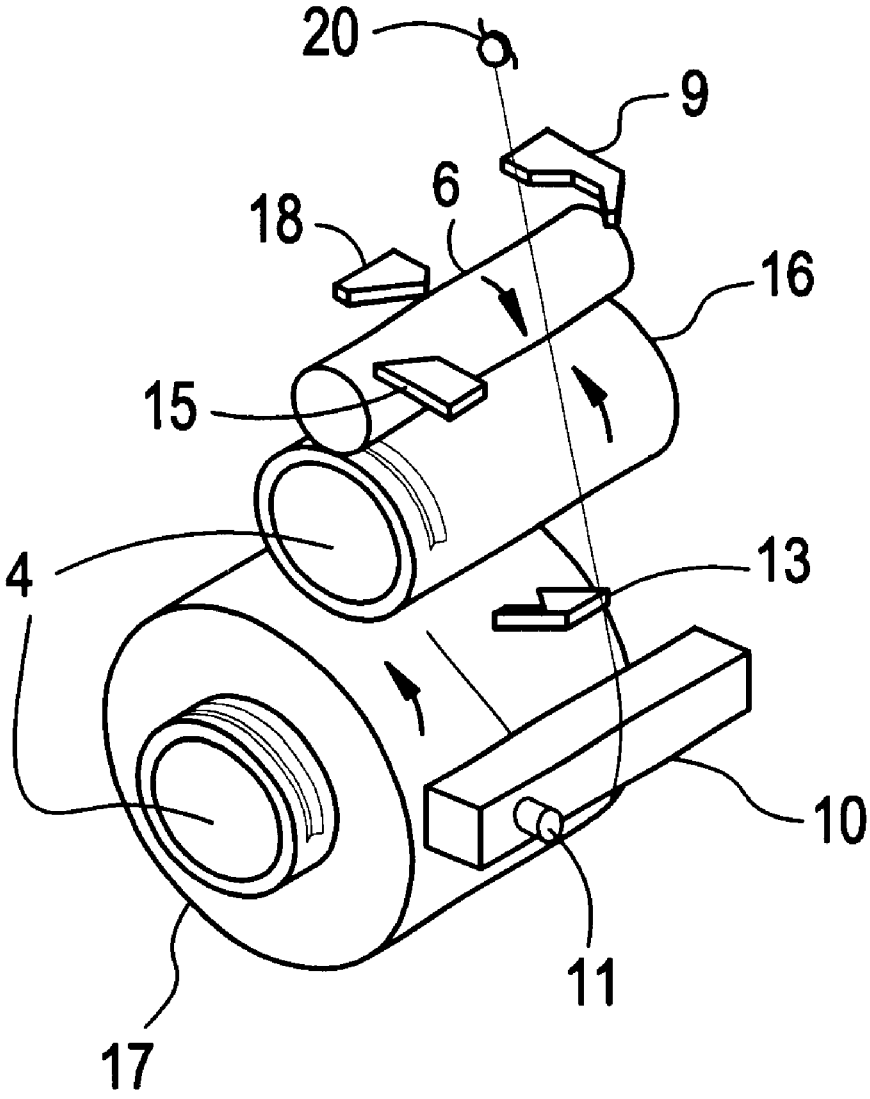
FIG. 12 is a schematic drawing showing the yarn transfer action of the yarn winding apparatus of the present invention.
Figure 19:
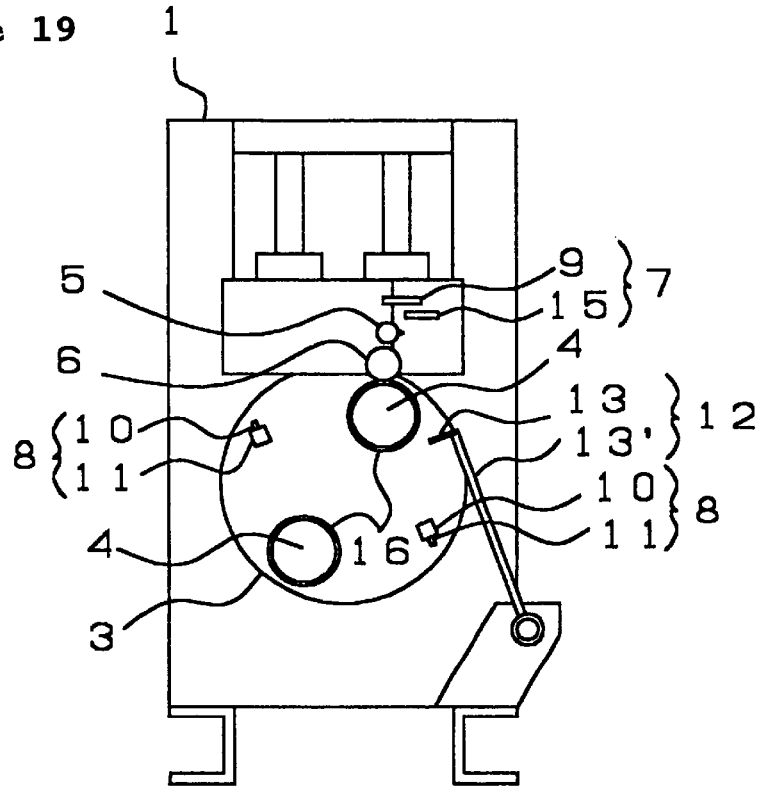
FIG. 19 is a schematic front view showing the yarn winding apparatus of the present invention.
Figure 20:
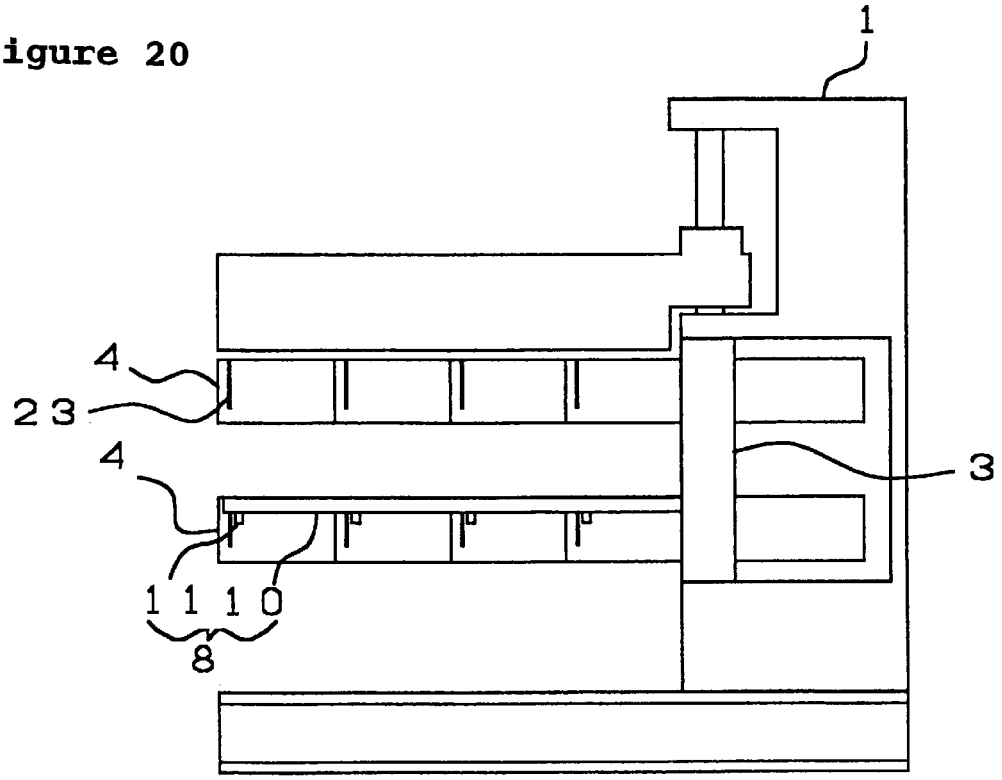
FIG. 20 is a schematic side view showing the yarn winding apparatus of the present invention.

FIGS. 12 to 16 are schematic drawings expressing the action of automatic transfer from a wound yarn package to an empty bobbin. FIG. 17 is a schematic front view showing a portion near an upper yarn transfer mechanism. FIG. 19 is a schematic front view showing a turret type multiple-yarn winding apparatus as an embodiment of the present invention. FIG. 20 is a schematic side view showing the same. At first, a turret plate 3 is rotated 180 degrees clockwise, to move wound yarn packages 17 at the winding position to the standby position, and the empty bobbins at the standby position to the winding position. At this time, as shown in FIG. 12, a yarn control guide 10 of a yarn control mechanism 8 is interlocked with the turret plate (not illustrated), to disengage the yarn from a traverse guide (not illustrated) in the direction perpendicular to the traverse direction, and controls and supports the yarn passage lest the yarn should contact the peripheral surface of the empty bobbin 16.

Figure 13:
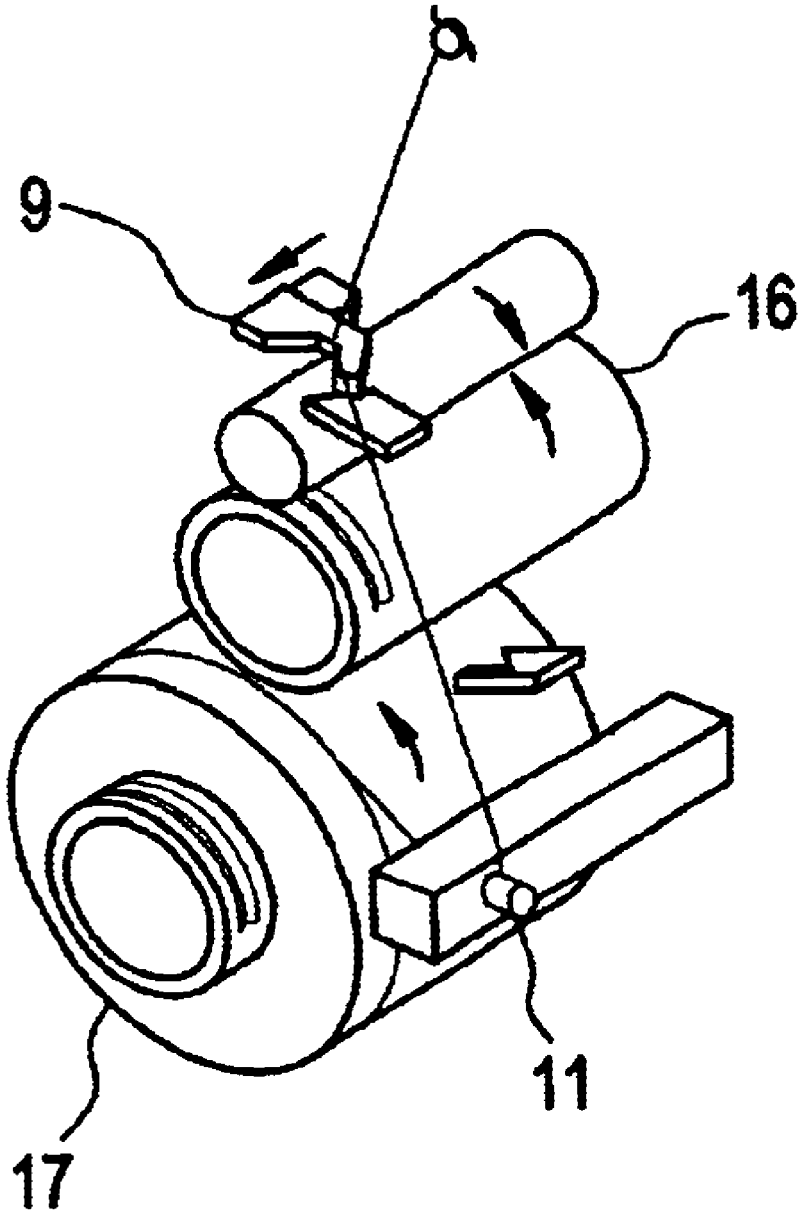
FIG. 13 is a schematic drawing showing the yarn transfer action of the yarn winding apparatus of the present invention.

Then, as shown in FIG. 13, the yarn is shifted outside the regular traverse width by a yarn shift guide 9 of an upper yarn transfer mechanism 7, and a surface bunching guide 11 of the yarn control mechanism 8 lets the yarn passage go toward the surface bunching position in the yarn winding of the wound yarn package 17.

Figure 14:
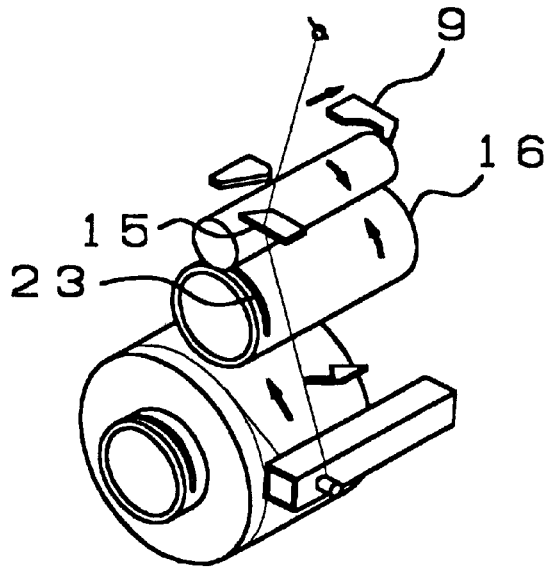
FIG. 14 is a schematic drawing showing the yarn transfer action of the yarn winding apparatus of the present invention.

Then, as shown in FIG. 14, the yarn shift guide 9 returns to its home position, and at this time, the yarn is taken over by a yarn keep guide 15 provided in the upper yarn transfer mechanism 7, and is supported above a yarn holding portion 23 extending in the circumferential direction in the surface of the empty bobbin 16.

Figure 15:
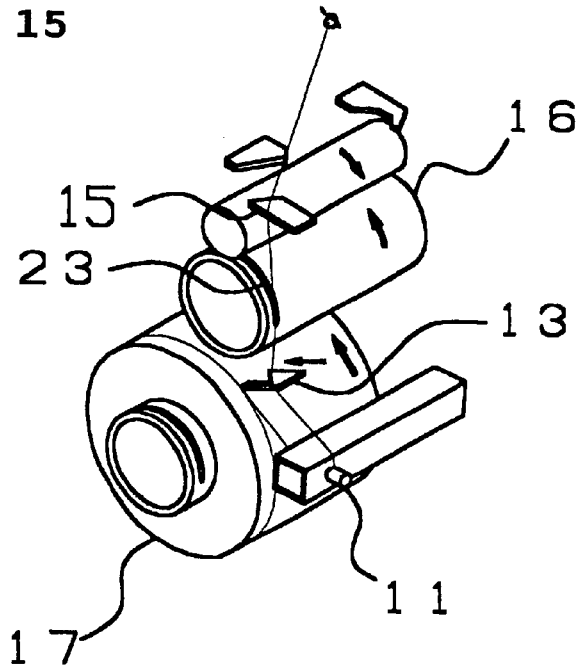
FIG. 15 is a schematic drawing showing the yarn transfer action of the yarn winding apparatus of the present invention.

Then, as shown in FIG. 15, an initial winding guide 13 of a lower yarn transfer mechanism 12 (not illustrated) goes into the space between the empty bobbin 16 and the yarn passage control mechanism 8, and the running yarn controlled in its passage by the yarn keep guide 15 and the surface bunching guide 11 of the yarn control mechanism 8 is brought into contact with the peripheral surface of the empty bobbin 16 by the initial winding guide 13 and shifted in the axial direction of the empty bobbin 16, being introduced into the yarn holding portion 23 of the empty bobbin 16 almost in parallel to the yarn holding portion 23, to be held. If the yarn is held, since both the wound yarn package 17 and the empty bobbin 16 rotate in the yarn winding direction, the yarn is pulled between the wound yarn package 17 and the empty bobbin 16, to be cut, causing the cut yarn to be transferred from the wound yarn package 17 to the empty bobbin 16.

Immediately after, the transferred yarn is quickly disengaged from the yarn keep guide 15, and starts moving toward the center of the traverse. The reason why the yarn is automatically disengaged from the yarn keep guide 15 is, as shown in FIG. 17, that the yarn keep guide 15 is installed at a position not crossing the yarn passage B (broken line) of the yarn wound by the winding apparatus immediately after yarn transfer and at a position crossing the yarn passage C of the yarn immediately before transfer.

Figure 16:
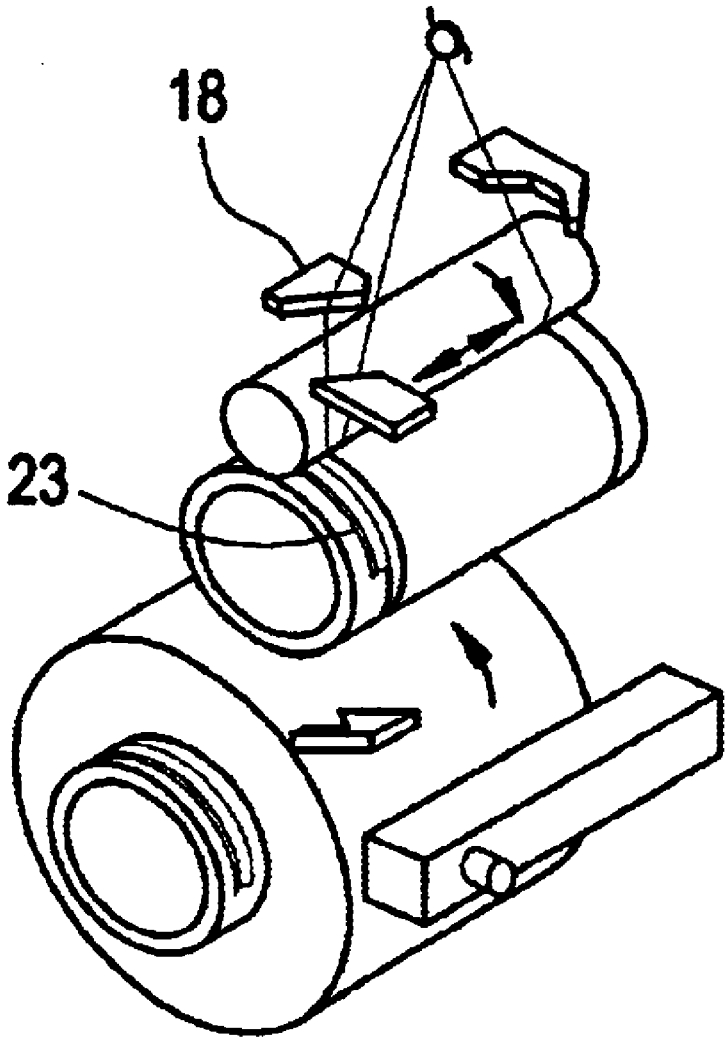
FIG. 16 is a schematic drawing showing the yarn transfer action of the yarn winding apparatus of the present invention.
Figure 17:
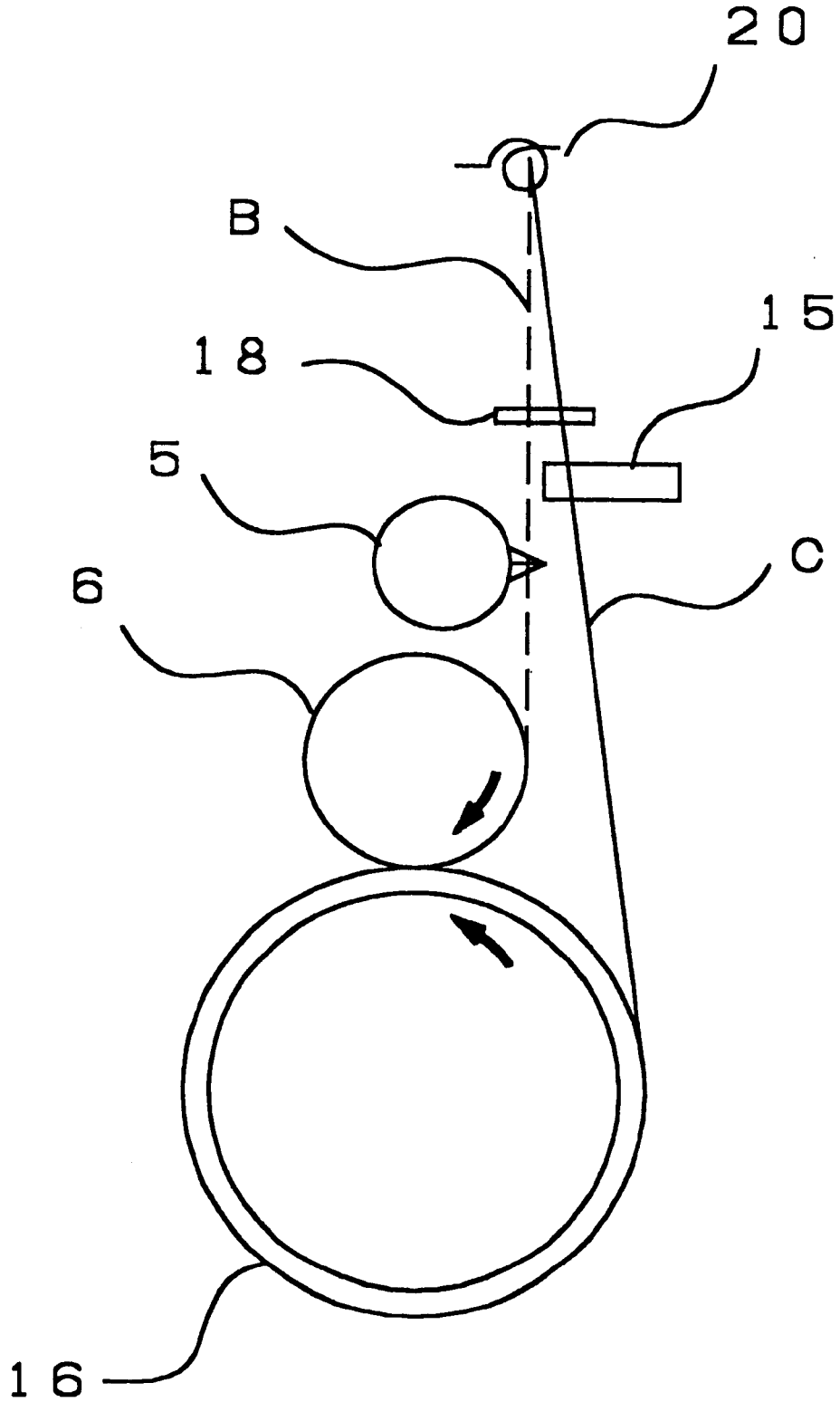
FIG. 17 is a schematic front view expressing the positional relation around the upper yarn transfer mechanism of the yarn winding apparatus of the present invention.

Then, as shown in FIG. 16, the yarn moving toward the center of the traverse contacts a resistance guide 18 provided between the yarn holding portion 23 and the traverse area, and receives a frictional force in the direction opposite to the center of the traverse, to be lowered in moving speed, and while a yarn tail with a predetermined length is formed, the yarn keeps moving toward the center of the traverse, to be finally taken over by the traverse guide (not illustrated), and is traversed and wound.

When the present invention is applied, it is especially desirable to use a turret type automatic winding apparatus, and furthermore, it is desirable to apply the present invention to high speed winding.

The yarn passage control guide 10 can also be actuated by an independent drive mechanism without being interlocked with the turret plate 3, and for disengaging the yarn from the traverse guide in the direction perpendicular to the traverse direction, a yarn disengaging guide can also be provided upstream of the pressure contact roller 6.

The means for bringing the yarn into contact with the peripheral surface of the empty bobbin can also be provided in the upper yarn transfer mechanism 7, or without using the upper yarn transfer mechanism and the lower yarn transfer mechanism, the yarn can also be brought into contact with the peripheral surface of the empty bobbin 16 when the empty bobbin 16 has been completely moved to the winding position. Furthermore, the means for shifting the yarn in the axial direction of the empty bobbin, to introduce it into the yarn holding portion can also be provided in the upper yarn transfer mechanism 7, and the means can also be provided in both the upper yarn transfer mechanism 7 and the lower yarn transfer mechanism 8.

Figure 1:
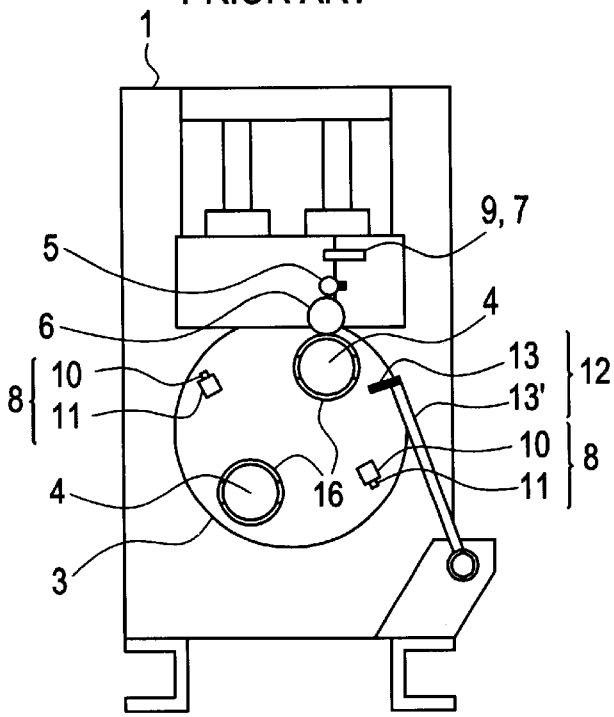
FIG. 1 PRIOR ART
FIG. 1 is a schematic front view showing a multiple-yarn winding apparatus of the prior art.
Figure 2:
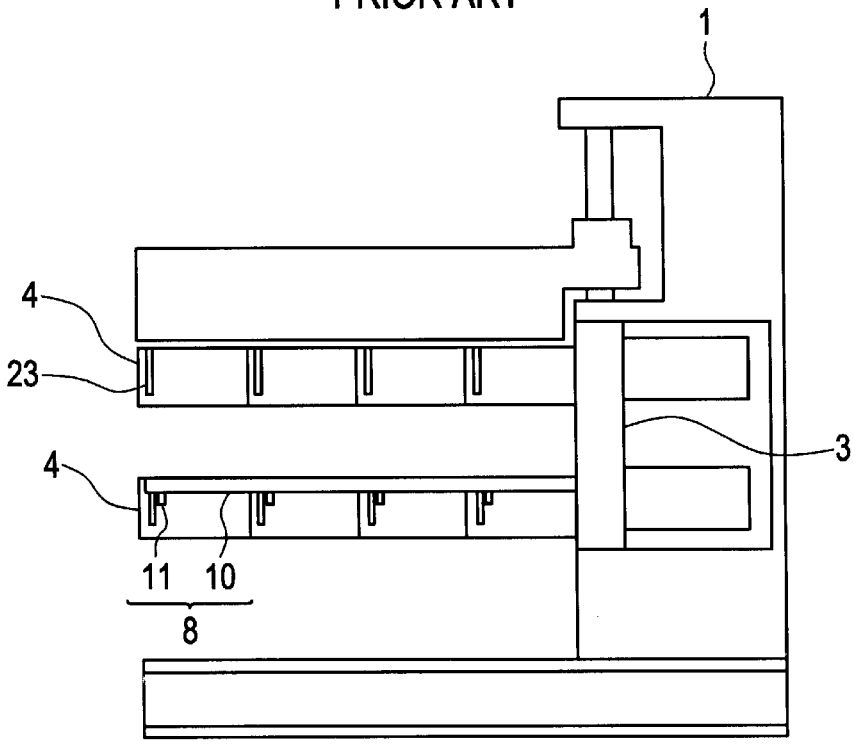
FIG. 2 PRIOR ART
FIG. 2 is a schematic side view showing a multiple-yarn winding apparatus of the prior art.
Figure 3:
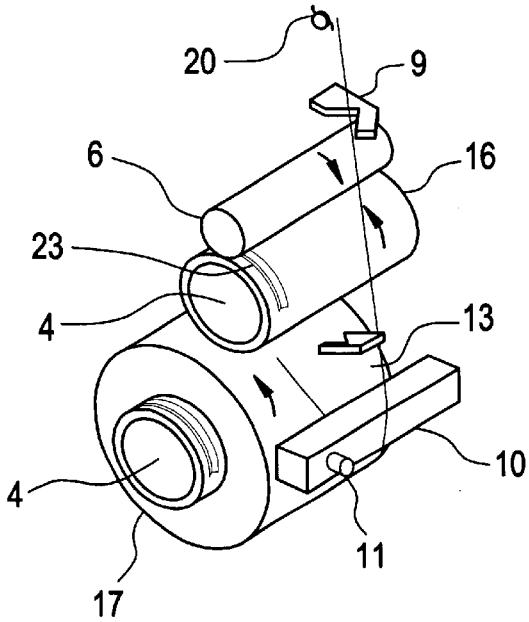
FIG. 3 PRIOR ART
FIG. 3 is a schematic drawing showing the yarn transfer action of one yarn only in the prior art.
Figure 4:
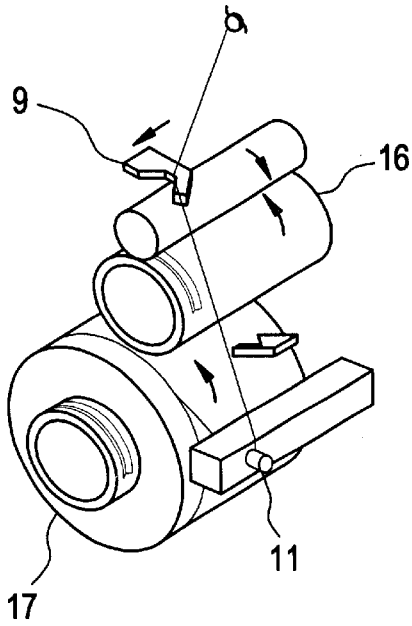
FIG. 4 PRIOR ART
FIG. 4 is a schematic drawing showing the yarn transfer action of one yarn only in the prior art.
Figure 5:
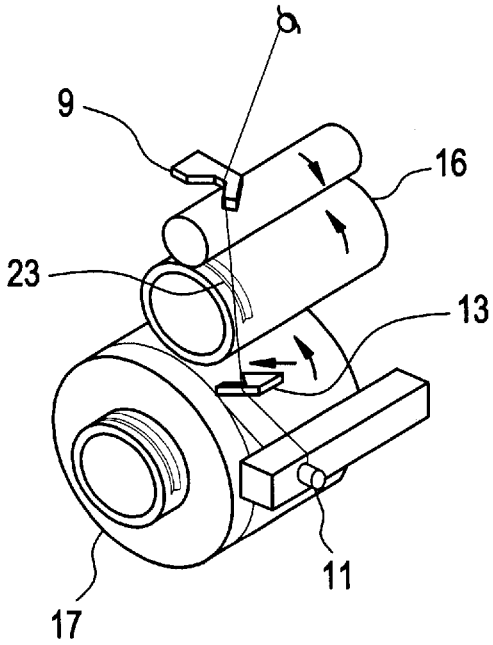
FIG. 5 PRIOR ART
FIG. 5 is a schematic drawing showing the yarn transfer action of one yarn only in the prior art.
Figure 6:
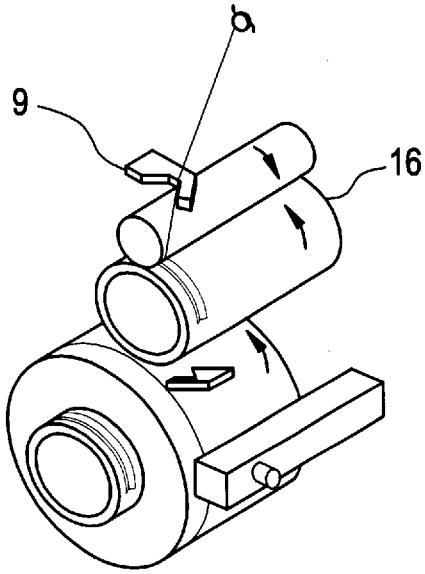
FIG. 6 PRIOR ART
FIG. 6 is a schematic drawing showing the yarn transfer action of one yarn only in the prior art.
Figure 7:
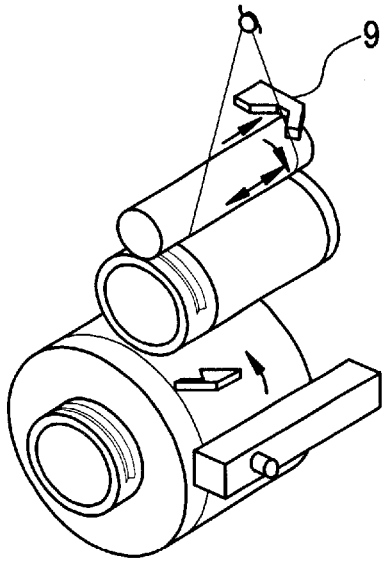
FIG. 7 PRIOR ART
FIG. 7 is a schematic drawing showing the yarn transfer action of one yarn only in the prior art.
Figure 8:
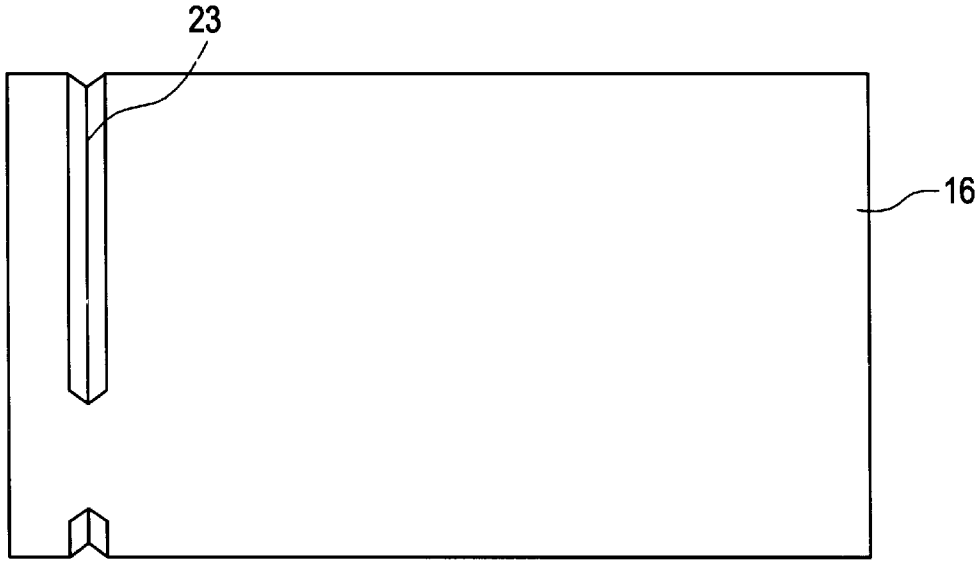
FIG. 8 is a schematic drawing showing a bobbin having a yarn holding slit.

It is preferable that the means for holding the yarn is, a yarn holding slit 23 extending in the circumferential direction in the surface of the empty bobbin at an end of the bobbin as shown in FIG. 8, and the yarn can also be held by using the border between adjacent yarn winding bobbins, or by using the border between a tubular member inserted between the yarn winding bobbins and the end of one of the yarn winding bobbins. Any other yarn holding means can also be adopted.

Figure 9:
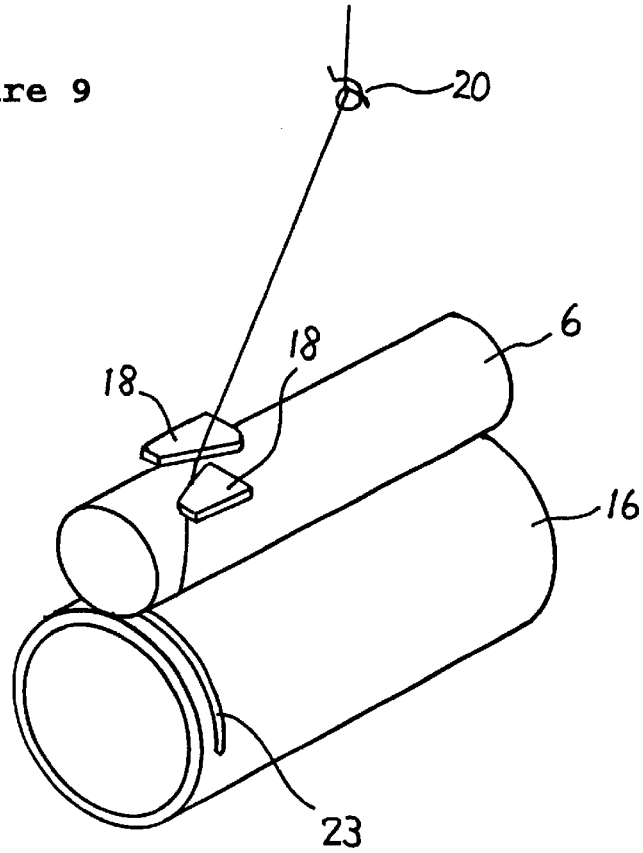
FIG. 9 is a schematic drawing showing a combination of plural resistance guides as a means for controlling the tail length of a yarn.
Figure 10:
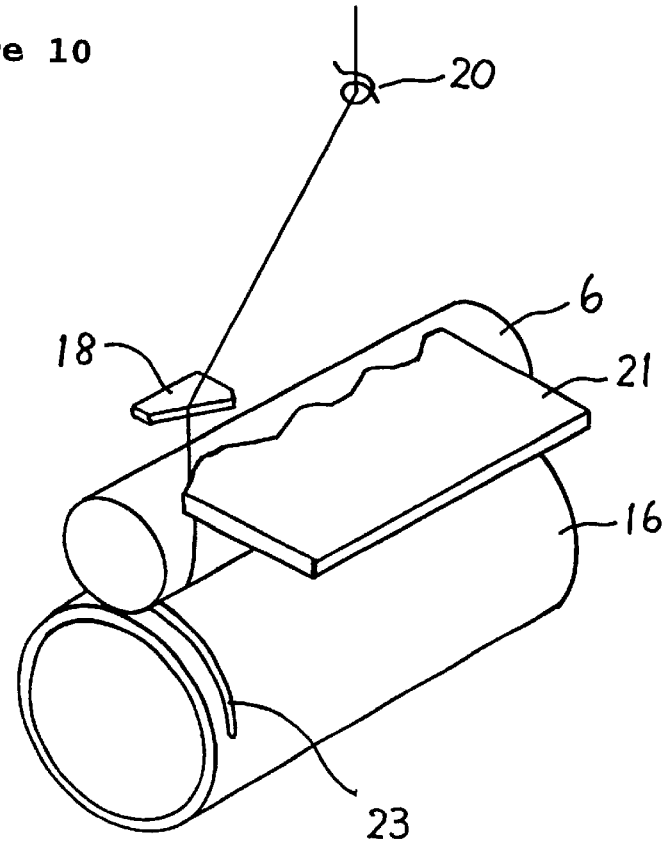
FIG. 10 is a schematic drawing showing one of resistance guides, used as a traverse control guide.
Figure 11:
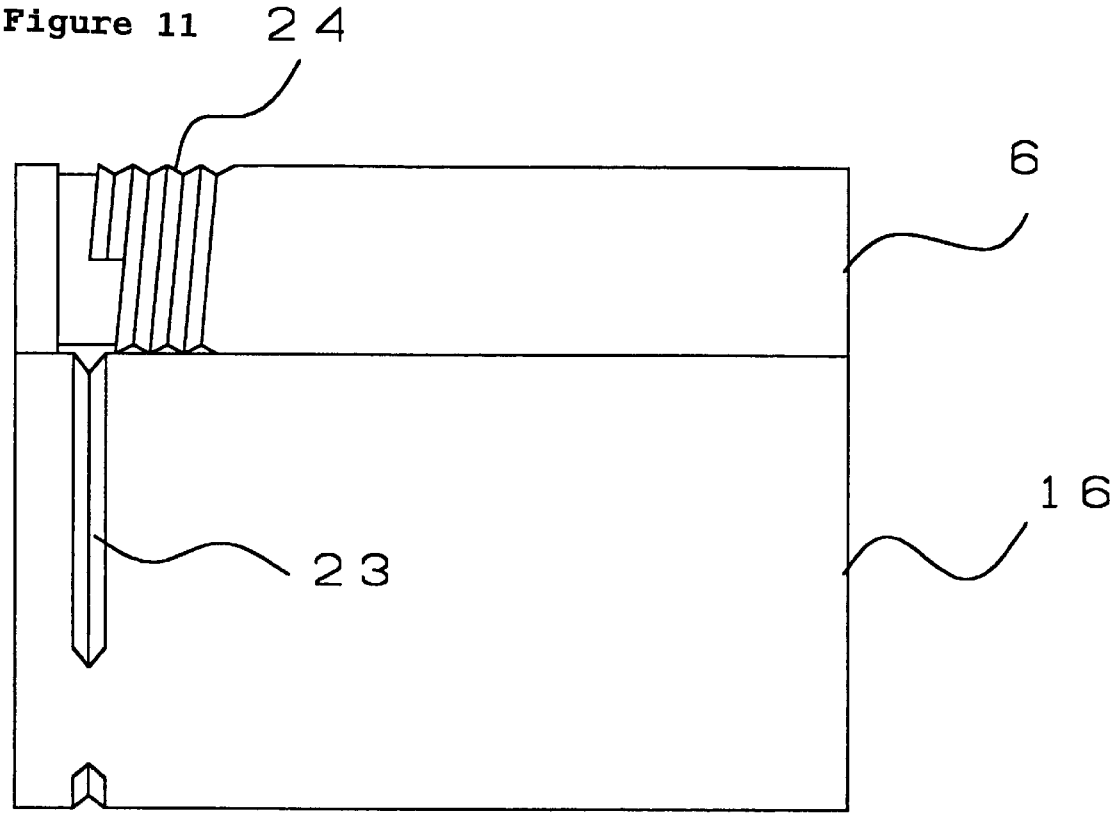
FIG. 11 is a schematic drawing showing a pressure contact roller with a threaded groove.

The means for controlling the tail length of the yarn can also be a combination of plural resistance guides 18 as shown in FIG. 9, instead of one resistance guide as mentioned above. One of the resistance guides can also be, as shown in FIG. 10, a traverse control guide 21 provided at a position opposite to the rotary vane used in the traverse device in reference to the traverse yarn passage defined by the traverse device provided as a rotary vane mechanism, or one of the resistance guides can also be a yarn disengaging guide for disengaging the yarn from the traverse guide in the direction perpendicular to the traverse direction at the time of yarn transfer. Furthermore, the means for controlling the tail length of the yarn can also be a rotating threaded groove, and a threaded groove 24 can also be formed in the contact pressure roll 6 as shown in FIG. 11.

When it becomes necessary to finely adjust the tail length of the yarn for any difference in yarn variety such as a physical property or thickness, etc. of the yarn to be wound, or due to the difference in tail splicing work environment, etc., it is preferable to change the frictional force of a resistance guide by adjusting the position of the resistance guide as a method of finely adjusting the tail length of the yarn. It is also preferable that two resistance guides in contact with the yarn are installed on both sides of the yarn, to change the frictional force of the resistance guides by changing the distance between the two guides. It is also preferable to change the frictional force of a resistance guide by adjusting the position of the traverse fulcrum guide.

Figure 18:
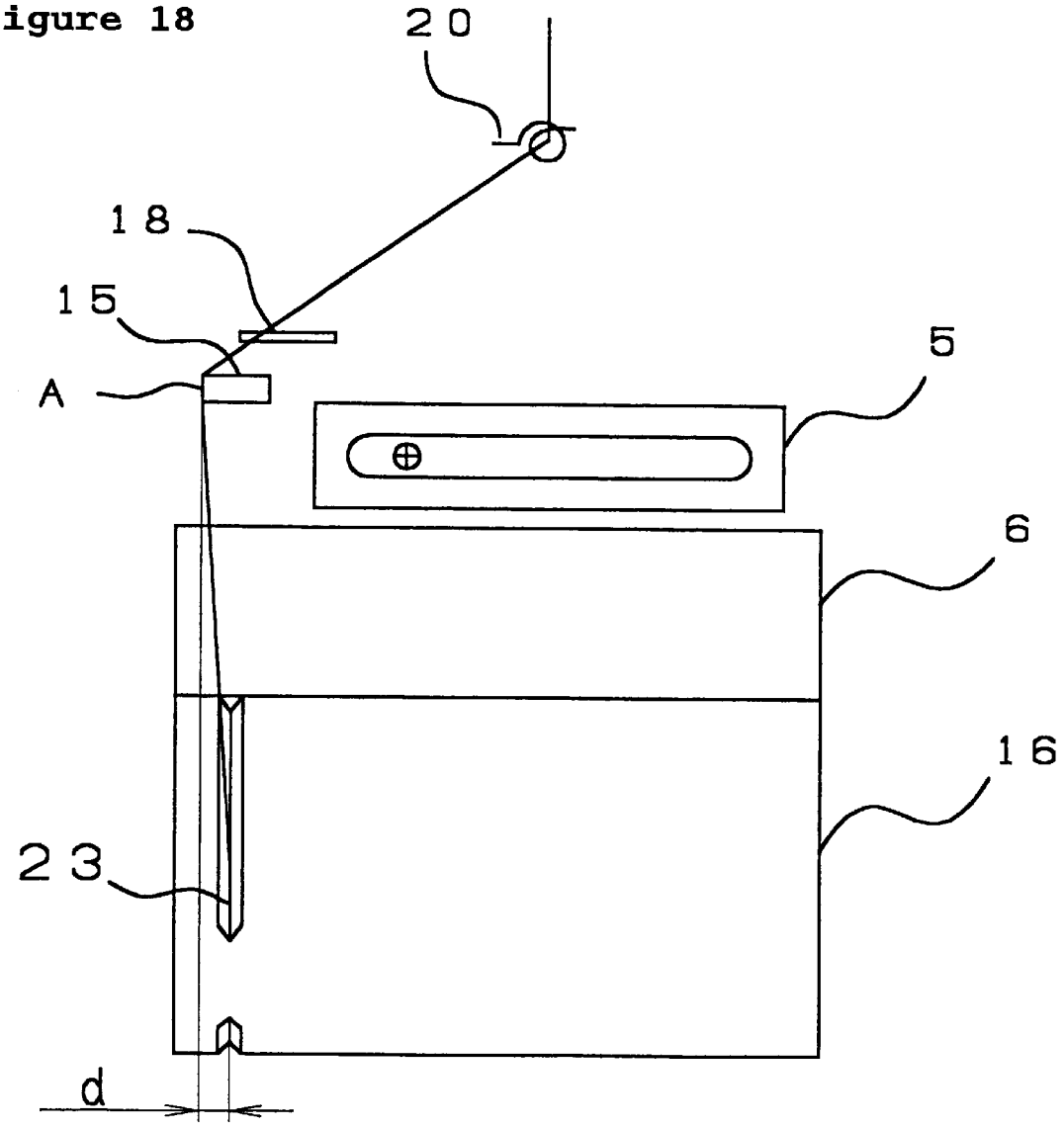
FIG. 18 is a schematic side view expressing the positional relation around the upper yarn transfer mechanism of the yarn winding apparatus of the present invention.

For preventing the tail splitting of the yarn, it is preferable that the position at which the yarn is disengaged from the yarn keep guide immediately after it has been held by the yarn holding portion is, as shown in FIG. 18, shifted from the yarn holding portion toward the non-traverse side (for example, point A), viewed in the direction perpendicular to the spindle axis. Moreover, for both the purposes of preventing the tail splitting and raising the successful bobbin-to-bobbin yarn transfer rate, it is preferable that the distance d (illustrated in FIG. 18) in the axial direction of the spindle between the yarn holding portion and the position where the yarn is disengaged from the yarn keep guide immediately after it has been held by the yarn holding portion is in a range of $0.007R \leqq d \leqq 0.07R$, where R is the outer diameter of the bobbin. The position where the yarn is disengaged from the yarn keep guide immediately after it has been held by the yarn holding portion also means the position where the yarn disengaged from the upper yarn transfer mechanism immediately after it has been held by the yarn holding portion if the means for shifting the yarn in the axial direction of the empty bobbin for introducing it into the yarn holding portion is provided in the upper yarn transfer mechanism.

To prevent that the end of the yarn winding of the wound yarn package slips from the surface of the wound yarn package, it is preferable that the position of the surface bunch formed on the surface of the wound yarn package is at least 5 mm or more inside from an end of the surface of the package, viewed in the direction perpendicular to the spindle shaft. It is more preferable that the position is 10 mm or more inside, and if the position is 20 mm or more inside, a remarkable effect can be manifested.

As the means for forming the surface bunch at least 5 mm inside from an end of the wound yarn package, it is desirable that the yarn support position of the surface bunching guide 11 is at least 5 mm or more inside from the end of the wound yarn package.

Figure 29:
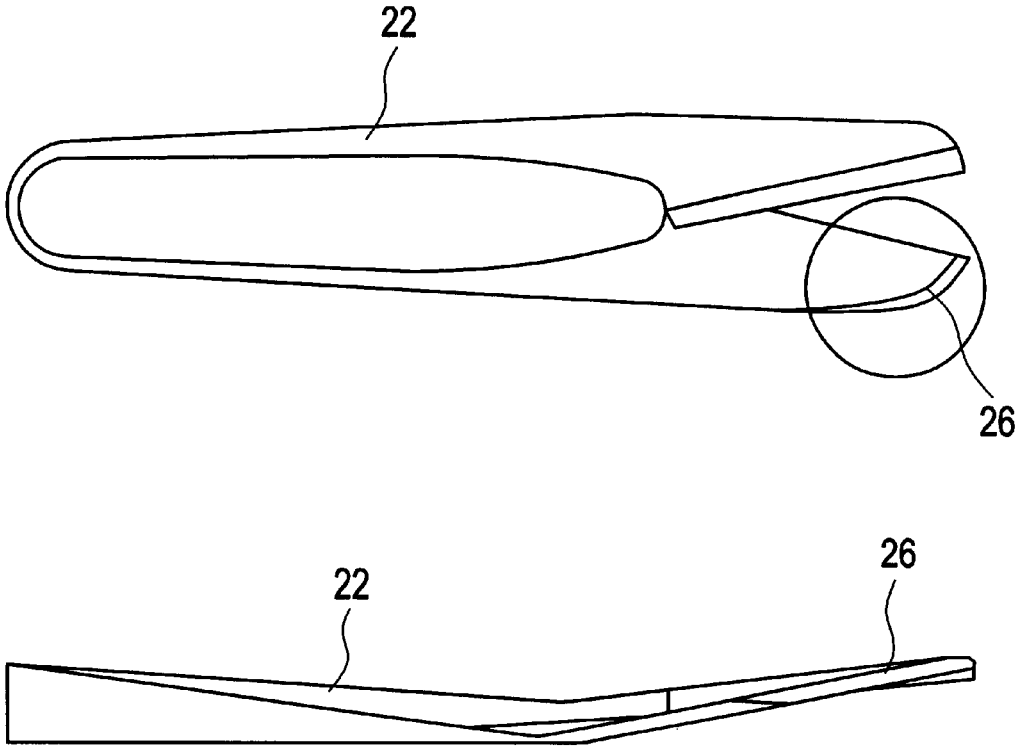
FIGS. 29 are schematic drawings showing thread cutting scissors suitably used for the tail splicing work of a yarn package obtained according to the method of the present invention.

For yarn tail splicing work for using a wound yarn package (for weaving or yarn processing, etc.), especially for simply taking out the yarn tail, it is preferable to cut the yarn tail by a blade surface. Furthermore, considering good working convenience, security of safety, and flawing of the bobbin surface, when an extra portion of the yarn is cut off after yarn splicing in the tail splicing work, it is more preferable to use scissors as shown in FIG. 29, in which at least one further other blade surface is provided in addition to the blade surfaces to be slid over each other of usually used thread scissors. FIGS. 29 show scissors 22 having such a further other blade surface 26. The scissors can be especially effectively used for cutting off the yarn tail.

The present invention is described below concretely in reference to examples.

Nylon 6 yarns were obtained by melt spinning, and provided for a winding process for winding at a winding speed of 3000 m/min.

For winding, turret type winding machine, KW-66A produced by Toray Engineering K.K. having two spindles, each mounted with eight yarn winding pirns with a bobbin diameter of 140 mm and a yarn holding slit was used, and whenever a package weight of 7.5 kg was reached by winding (350 mm in diameter), the yarn was automatically transferred for evaluation under the following five categories.

Evaluation 1 evaluated the successful bobbin-to-bobbin yarn transfer rate and the yarn tail splitting of each fully wound package.

Evaluation 2 evaluated the length of the yarn tail formed near the yarn holding portion of each fully wound package.

Evaluation 3 evaluated the yarn tail length adjusting function.

Evaluation 4 evaluated the position of the surface bunch formed on the surface of each fully wound package, and the yarn slippage of the wound yarn end of the yarn package from the surface of the package.

Evaluation 5 evaluated the yarn tail cutting method in the tail splicing work.

EVALUATION 1

At first, the successful bobbin-to-bobbin yarn transfer rate and the yarn tail splitting of each package were evaluated. When 50-denier yarns respectively consisting of 40 filaments were wound, yarn keep guides straight in the yarn keeping portion, with the straight portion kept perpendicular to the spindle axis, were used, and the straight portion of each yarn keep guide was positioned 1 mm on the non-traverse side from the yarn holding portion extending in the circumferential direction in the surface at one end of each pirn, viewed in the direction perpendicular to the spindle axis (Example 1), or positioned 5 mm on the non-traverse side from the yarn holding portion (Example 2), or positioned 9 mm on the non-traverse side from the yarn holding portion, or positioned 1 mm on the traverse side (Example 4), or positioned right above the yarn holding portion (Example 5), or positioned 12 mm on the non-traverse side from the yarn holding portion (Example 6), for evaluation of automatic bobbin-to-bobbin yarn transfer. The successful bobbin-to-bobbin yarn transfer rates of fully wound yarn packages and the occurrences of yarn tail splitting are shown in Table 1.

In Examples 1 to 3, automatic bobbin-to-bobbin yarn transfer could be effected at a success rate of 100%, and no yarn tail splitting occurred. In Examples 4 and 5, the success rate was 100% and some yarn tail splitting occurred. In Example 6, the success rate was 95.0%, and the yarn tail splitting did not occur.

TABLE 1

| | Successful bobbin-to-bobbin yarn transfer rate | Yarn tail splitting |
|---|---|---|
| Example 1 | 100% (40/40) | Did not occur |
| Example 2 | 100% (40/40) | Did not occur |
| Example 3 | 100% (40/40) | Did not occur |
| Example 4 | 100% (40/40) | Some splitting occurred |
| Example 5 | 100% (40/40) | Some splitting occurred |
| Example 6 | 95.0% (38/40) | Did not occur |

EVALUATION 2

Figure 21:
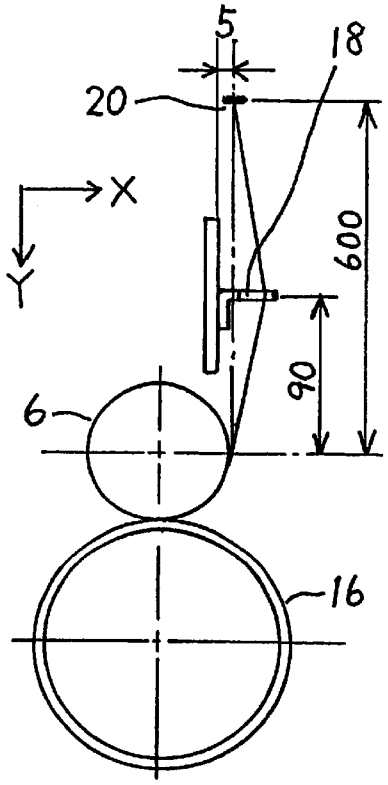
FIG. 21 is a front view for illustrating a case where one resistance guide is provided as a means for controlling the length of the tail yarn.
Figure 22:
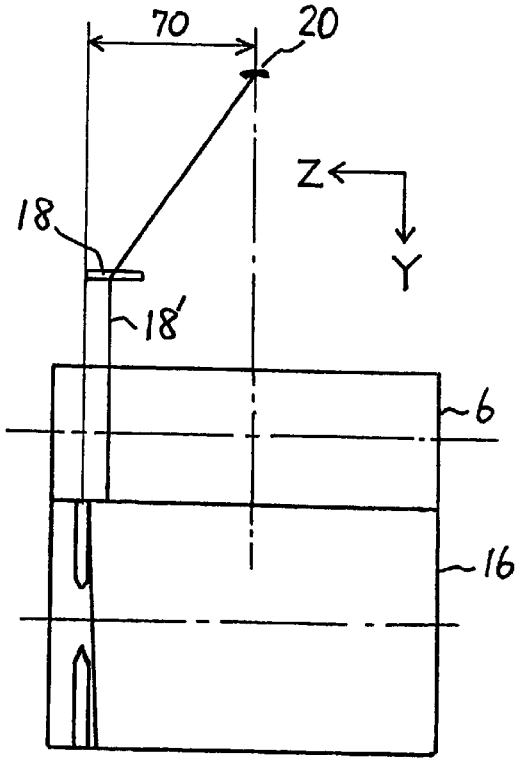
FIG. 22 is a side view corresponding to the front view of FIG. 21, for illustrating a case where one resistance guide is provided as a means for controlling the length of the tail yarn.
Figure 23:
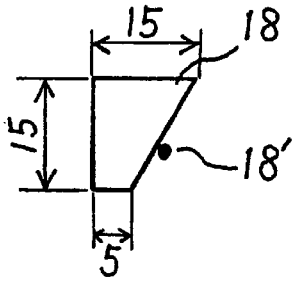
FIG. 23 is a plan view showing the resistance guide used in the embodiment shown in FIGS. 21 and 22.
Figure 24:
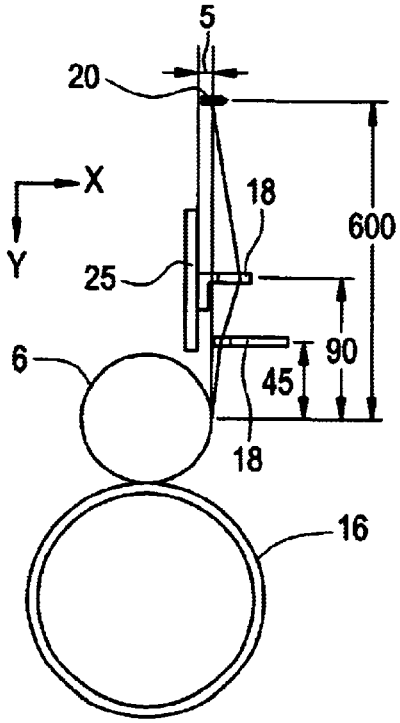
FIG. 24 is a front view for illustrating a case where two resistance guides are provided.
Figure 25:
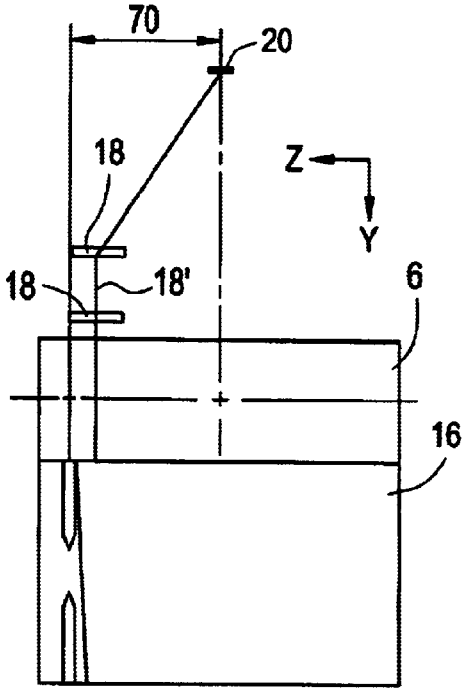
FIG. 25 is a side view corresponding to the front view of FIG. 24, for illustrating a case where two resistance guides are provided.
Figure 26:
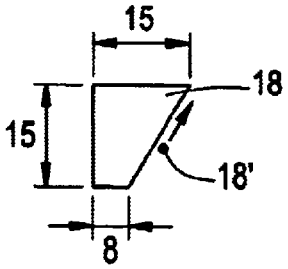
FIG. 26 is a plan view for showing one of the resistance guides used in the embodiment shown in FIGS. 24 and 25.
Figure 27:
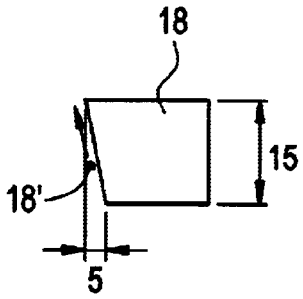
FIG. 27 is a plan view for showing the other resistance guide used in the embodiment shown in FIGS. 24 and 25.
Figure 28A:
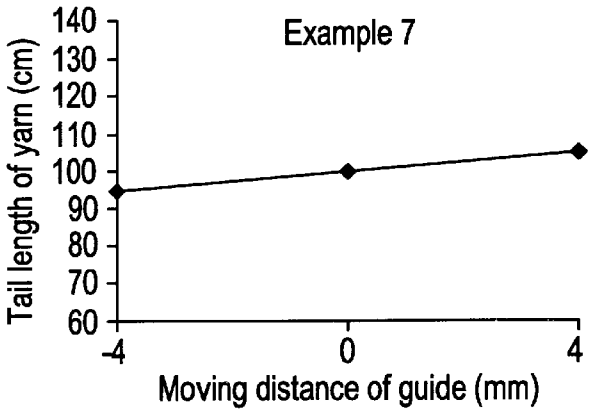
FIG. 28 shows examples in which the yarn tail length fine adjusting function is evaluated.
Figure 28B:
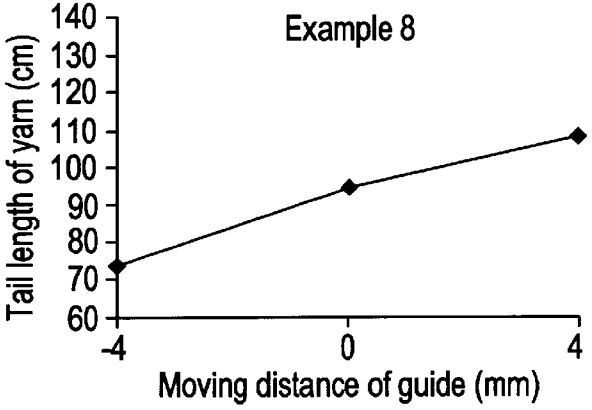
Figure 28C:
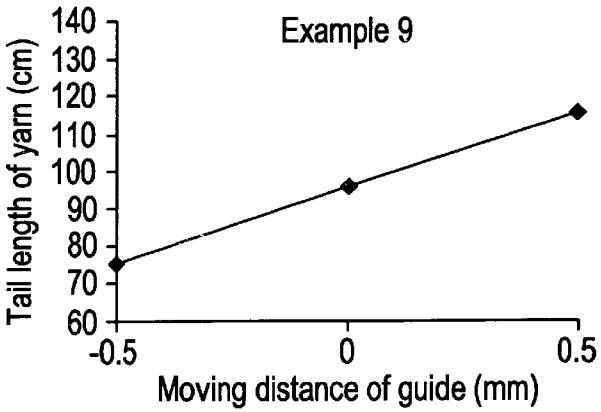
Figure 28D:
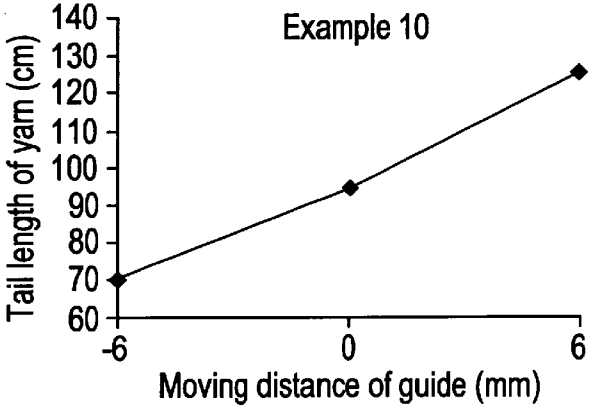

The length of the yarn tail formed near the yarn holding portion of each fully wound package was evaluated using 50-denier yarns respectively consisting of 40 filaments. The means used for controlling the length of the yarn tail was one resistance guide (FIG. 23) as shown in FIG. 21 (front view) and FIG. 22 (side view) (Example 7), or a combination of two resistance guides (FIGS. 26 and 27) with dimensions as shown in FIG. 24 (front view) and FIG. 25 (side view) (Example 8), or a threaded groove formed in a contact pressure roller as shown in FIG. 11 (Example 9), or was not used (Example 10). The results are shown in Table 2. The lengths of the yarn tails in Examples 7 to 9 were 80 to 100 cm, sufficient and appropriate lengths for the tail shift work. On the other hand, also in Example 10, the length of the yarn tail was 25 cm.

TABLE 2

| | Length of yarn tail |
|---|---|
| Example 7 | 100 |
| Example 8 | 95 |
| Example 9 | 140 |
| Example 10 | 25 |

EVALUATION 3

Fifty-denier yarns respectively consisting of 17 filaments were used for evaluating the yarn tail length fine adjusting function. The resistance guide of Example 7 was moved in the yarn running direction 4 mm closer to the contact pressure roller (+ direction) and 4 mm farther away from it (– direction) (Example 11), or the upper one of the two resistance guides of Example 8 was moved in the yarn running direction 4 mm closer to the contact pressure roller (+ direction) and 4 mm farther away from it (– direction) (Example 12), or the upper one of the two resistance guides of Example 8 was moved 0.5 mm farther away from the front plate 25 fastening the guide shown in FIG. 24 (+ direction) and 0.5 mm closer to it (– direction) (Example 13), or the position of the traverse fulcrum guide under the conditions of Example 8 was moved 6 mm closer to the yarn holding portion (+ direction) and 6 mm farther away from it (– direction) (Example 14), to measure the length of the yarn tail respectively for comparison with Example 7 or 8 (moving distance 0 mm).

The results are shown in FIGS. 28. In each graph, the moving distance was chosen as the abscissa, and the length of the yarn tail, as the ordinate. It can be seen that in all of Examples 11 to 14, the length of the yarn tail could be finely adjusted.

EVALUATION 4

The position of the surface bunch formed on the surface of each fully wound package and the yarn slippage of the wound yarn end of the yarn package from the surface of the package were evaluated using 30-denier yarns respectively consisting of 10 filaments. The winding position of the surface bunch formed on the surface was 5 mm from an end of the wound yarn package (Example 15), or 10 mm (Example 16), or 20 mm (Example 17). Furthermore, the winding position of the surface bunch formed on the surface was kept at 1 mm from an end of the wound yarn package (Example 18), or 3 mm (Example 19), or 4 mm (Example 20). After completion of automatic bobbin-to-bobbin yarn transfer in these conditions, the yarn slippage of the wound yarn ends of fully wound yarn packages from the surfaces of the packages was evaluated, and the results are shown in Table 3.

TABLE 3

| | Number of automatically transferred yarn packages | Number of yarn slipping packages | Yarn slippage probability (%) |
|---|---|---|---|
| Example 15 | 80 | 5 | 6.3 |
| Example 16 | 80 | 2 | 2.5 |
| Example 17 | 80 | 0 | 0.0 |
| Example 18 | 80 | 30 | 37.5 |
| Example 19 | 80 | 18 | 22.5 |
| Example 20 | 80 | 11 | 13.8 |

In Examples 15 to 17, the yarn slippage probabilities of wound yarn ends of fully wound yarn packages from the surfaces of the packages were 6.33% or less. In Example 17, the slippage probability was 0.0%. In Examples 18 to 20, the yarn slippage probabilities of wound yarn ends of fully wound yarn packages from the surfaces of the packages were 37.5% (Example 18), 22.5% (Example 19) and 13.8% (Example 20), showing somewhat high levels.

EVALUATION 5

The methods for cutting yarn tails in the tail splicing work were evaluated.

Forty nylon 6 yarn packages, in each of which a 100 cm tail extending from the initial end of the yarn held in the yarn holding slit formed in the circumferential direction at an end of the pirn, to the yarn package proper was wound around the surface of the pirn, were entrusted to respectively 20 male and female workers engaged in tail splicing work, and the workers were instructed to cut the yarn tails and to evaluate on three items of safety (o or x), working convenience (o or x) and pirn flawing (visual) (o or x).

For cutting, marketed cutters-were used (Example 21), or marketed thread scissors were used (not as scissors, but by using the blade of one side only as a cutter) (Example 22), or thread cutters with a further other blade surface formed on the side opposite to the blade surface of one of the blades to be slid over each other, as shown in FIG. 29, were used (Example 23). The, evaluation results are shown in Table 4.

Examples 21 to 23 were good with the good safety rate at 63% or more and the good working convenience rate of 75% or more. Especially in Example 23, the good safety rate and the good working convenience rate were 98%, and the pirn flawing rate was 0%.

TABLE 4

| | Good safety rate | Good working convenience rate | Pirn flawing rate |
|---|---|---|---|
| Example 21 | 63% (25/40) | 80% (32/40) | 23% (9/40) |
| Example 22 | 88% (35/40) | 75% (30/40) | 10% (4/40) |
| Example 23 | 98% (39/40) | 98% (39/40) | 0% (0/40) |

INDUSTRIAL APPLICABILITY

The present invention is suitable for the yarn winding process. Especially in the production of synthetic fibers, it is effective for a winding machine for winding yarns at a high speed while automatically transferring yarns from bobbin to bobbin, and manifests an effect in the subsequent step of tail splicing for weaving or knitting a fabric or falsely twisting, etc.

What is claimed is:

1. A method for winding a yarn in which the yarn is wound around an empty bobbin with a yarn winding apparatus comprising a traverse fulcrum guide for winding the yarn, a traverse device for traversing the yarn through a regular traverse area before winding, a contact pressure roller for providing a predetermined face pressure to the wound yarn in contact therewith, two spindles alternately displaced between a winding side and a stand by side for winding the traversed yarn, a moving device which moves the spindles to continuously transfer the yarn from the spindle on the winding side to the spindle on the standby side, and a yarn transfer device to introduce the yarn into a yarn holding portion of an empty bobbin on the winding side spindle to hold the yarn, wherein said yarn transfer device comprises an upper yarn transfer mechanism provided upstream of the empty bobbin mounted around the spindle on the winding side, a lower yarn transfer mechanism provided downstream of the empty bobbin, and a yarn passage control mechanism to control passage of the yarn extending to a wound yarn package moved to the standby side, comprising:

shifting the yarn outside the regular traverse area with a yarn shift guide of the upper yarn transfer mechanism;

maintaining the yarn at a stationary yarn keep guide;

returning the yarn shift guide to its original position;

moving the yarn to a yarn holding portion of the empty bobbin for almost parallel introduction by the lower yarn transfer mechanism;

holding the yarn at the holding portion of the empty bobbin;

moving the yarn at the holding portion in a rotating direction of the empty bobbin reverse to a running direction of the yarn;

automatically disengaging the yarn from the stationary yarn keep guide of the upper yarn transfer mechanism;

moving the yarn toward a center portion of the regular traverse area without forming an initially straight-wound yarn tail bunch; and starting regular winding when the yarn is engaged with the traverse guide.

2. A method according to claim 1, wherein the lower yarn transfer mechanism is an initial winding guide which brings the yarn controlled by the upper yarn transfer mechanism and the yarn passage control mechanism into contact with the peripheral surface of the empty bobbin, shifts it in the axial direction of the empty bobbin and lets the yarn holding portion hold the yarn.

3. A method according to claim 1 or 2, wherein the length of a yarn tail, would after the yarn held by the yarn holding portion begins to be wound around the surface of the yarn winding bobbin until the yarn moving toward the center of the regular traverse area goes into the regular traverse area, is controlled at 10 cm to 200 cm.

4. A method for winding synthetic fibers, according to claim 1, wherein the length of the yarn tail is controlled by a resistance guide kept in contact with the yarn to produce a frictional resistance when the yarn is moved toward the center of the regular traverse area.

5. A method according to claim 4, wherein the resistance guide is a traverse control guide provided at a position opposite to a rotary vane used in the traverse device in reference to the traverse yarn passage defined by the traverse device provided as a rotary vane mechanism.

6. A method according to claim 4, wherein the resistance guide is a yarn disengaging guide for disengaging the yarn from the traverse guide in a direction perpendicular to the traverse direction at the time of yarn transfer from bobbin to bobbin.

7. A method according to claim 4, wherein a combination of at least two or more resistance guides is used instead of the resistance guide.

8. A method according to claim 4 or 7, wherein the length of the yarn tail is finely adjusted by adjusting the position of at least one of the resistance guides.

9. A method according to claim 4, wherein the length of the yarn tail is finely adjusted by adjusting the position of the traverse fulcrum guide.

10. A method according to claim 1, wherein when the yarn is moved toward the center of the regular traverse area, the yarn is supported by a threaded groove to control the length of the yarn tail by the rotation of the threaded groove.

11. A method according to claim 10, wherein the threaded groove is formed in the surface of the contact pressure roller.

12. A method according to claim 1 or 2, wherein the yarn holding portion is a slit extending in the circumferential direction in the surface at an end of the yarn winding bobbin.

13. A method according to claim 1 or 2, wherein the yarn holding portion is formed at a border between adjacent yarn winding bobbins.

14. A method according to claim 1 or 2, wherein the yarn holding portion is formed by the border between an end of a yarn winding bobbin and a tubular member.

15. A method according to claim 1 or 2, wherein a position where the yarn is disengaged from the yarn keep guide immediately after the yarn has been held by the yarn holding portion is on a non-traverse side in reference to the yarn holding portion, viewed in a direction perpendicular to the spindle axis.

16. A method according to claim 1 or 2, wherein the surface bunch of the wound yarn package is formed at least 5 mm or more inside from an end of the yarn wound package.

17. A yarn winding apparatus in which a yarn is wound around an empty bobbin comprising:

a) a traverse fulcrum guide for winding the yarn;

b) a traverse device for traversing the yarn before winding the yarn;

c) a contact pressure roller to produce a predetermined face pressure to the wound yarn in contact therewith;

d) two spindles alternately used for winding traversed yarn;

e) a moving device which moves the spindles to continuously transfer the yarn from the spindle on a winding side to the spindle on a standby side; and f) a yarn transfer device to introduce the yarn into a yarn holding portion for holding the yarn, wherein said yarn transfer device comprises:

i) an upper yarn transfer mechanism provided upstream of the empty bobbin mounted around the spindle on the winding side;

ii) a lower yarn transfer mechanism provided downstream of the empty bobbin; and iii) a yarn passage control mechanism to control passage of the yarn extending to the wound yarn package moved to the standby side;

wherein the yarn winding apparatus is provided with a resistance guide which contacts the yarn to produce a frictional resistance when the yarn is moved toward the center of the regular traverse area, wherein the yarn is moved outside the regular traverse area by a yarn shift guide of the upper yarn transfer mechanism to be kept at a stationary yarn keep guide of the upper yarn transfer mechanism, and returning the yarn shift guide to its original position, and moved to a yarn holding portion of the empty bobbin for almost parallel introduction by the lower yarn transfer mechanism, to be held and cut by the yarn holding portion such that 1) the holding point of the yarn is allowed to move in a rotating direction of the empty bobbin reverse to a running direction of the yarn, 2) the yarn is allowed to be automatically disengaged from the stationary yarn keep guide and is moved toward the center of the regular traverse area without forming an initially straight-wound yarn tail bunch and comes into contact with the resistance guide, to be lowered in moving speed, and while a yarn tail is formed, and 3) when the yarn is engaged with the traverse guide, regular winding is started.

18. A yarn winding apparatus, according to claim 17, wherein the lower yarn transfer mechanism is an initial winding guide which brings yarn controlled by the upper yarn transfer mechanism and the yarn passage control mechanism into contact with a peripheral surface of the empty bobbin, shifts the yarn in the axial direction of the empty bobbin and lets the yarn holding portion hold the yarn.

19. A yarn winding apparatus, according to claim 17 or 18, wherein the length of a yarn tail wound after the yarn held by the yarn holding portion begins to be wound around the surface of the yarn winding bobbin until the yarn moving toward the center of the traverse goes into the regular traverse area, is controlled at 10 cm to 200 cm.

20. A yarn winding apparatus, according to claim 17, wherein a combination of at least two or more resistance guides is used instead of the resistance guide.

21. A yarn winding apparatus, according to claim 17, wherein the length of the yarn tail is finely adjusted by adjusting the position of at least one of the resistance guides.

22. A yarn winding apparatus, according to claim 17, wherein the length of the yarn tail is finely adjusted by adjusting the position of the traverse fulcrum guide.

23. A yarn winding apparatus, according to claim 17, wherein one of the resistance guides is a traverse control guide provided at a position opposite to the rotary vane used in the traverse device in reference to the traverse yarn passage defined by the traverse device provided as a rotary van mechanism.

24. A yarn winding apparatus, according to claim 17, wherein one of the resistance guides is a yarn disengaging guide for disengaging the yarn from the traverse guide in the direction perpendicular to the traverse direction at the time of yarn transfer from bobbin to bobbin.

25. A yarn winding apparatus, according to claim 17, wherein when the yarn is moved toward the center of the traverse, the yarn is supported by a threaded groove, for controlling the length of the yarn tail by the rotation of the threaded groove.

26. A yarn winding apparatus, according to claim 25, wherein the threaded groove is formed in the surface of the contact pressure roller.

27. A yarn winding apparatus, according to claim 17, wherein the yarn holding portion is a slit extending in the circumferential direction in the surface at an end of the yarn winding bobbin.

28. A yarn winding apparatus, according to claim 17, wherein the yarn holding portion is formed at the border between adjacent yarn winding bobbins.

29. A yarn winding apparatus, according to claim 17, wherein the yarn holding portion is formed by the border between the end of a yarn winding bobbin and a tubular member.

30. A yarn winding apparatus, according to claim 17, wherein the position where the yarn is disengaged from the yarn keep guide immediately after the yarn has been held by the yarn holding portion is on the non-traverse side in reference to the yarn holding portion, viewed in the direction perpendicular to the spindle axis.

* * * * *